US005207719A

United States Patent [19]

Janus

[11] Patent Number: 5,207,719

[45] Date of Patent: May 4, 1993

[54] JOGGERS AID

[75] Inventor: Ronald E. Janus, Deerfield Beach, Fla.

[73] Assignee: Ji-Sco-Ni Enterprises, Inc., Chicago, Ill.

[21] Appl. No.: 487,411

[22] Filed: Mar. 2, 1990

Related U.S. Application Data

[63] Continuation of Ser. No. 927,159, Nov. 5, 1986, abandoned, which is a continuation of Ser. No. 798,406, Nov. 15, 1985, abandoned.

[51] Int. Cl.[5] ..... A45F 5/00

[52] U.S. Cl. ..... 224/148; 224/202; 215/1 A

[58] Field of Search ..... 224/148, 202, 205, 207; 220/425, 3.1, DIG. 13; 2/197, 183; 215/1 A, 100 A; 383/907; 206/806; 229/7.5

[56] References Cited

U.S. PATENT DOCUMENTS

| | | | |
|---|---|---|---|
| D. 160,314 | 10/1950 | Fuller | 206/553 X |
| 298,985 | 5/1884 | Kimball . | |
| 333,139 | 9/1861 | Garrick . | |
| 1,637,635 | 11/1926 | Corley . | |
| 2,013,475 | 9/1935 | Orton | 215/1 A |
| 2,057,933 | 10/1936 | Brinkman | 224/148 |
| 2,945,614 | 7/1960 | Wittmann, Sr. | 224/148 |
| 3,065,944 | 11/1962 | Liebendorfer | 224/148 X |
| 3,106,312 | 10/1963 | Hitchcock | 215/1 A |
| 3,197,099 | 7/1965 | Doba | 224/207 X |
| 3,730,336 | 5/1973 | Feldman | 229/7.5 X |
| 3,814,288 | 6/1974 | Westrich | 224/202 X |
| 3,830,270 | 8/1974 | Hagert et al. | 383/907 |
| 4,090,650 | 5/1978 | Gotta . | |
| 4,139,130 | 2/1979 | Gluskr et al. . | |
| 4,140,254 | 2/1979 | Land | 224/148 |
| 4,165,814 | 8/1979 | Seel | 220/212 X |
| 4,176,772 | 12/1979 | Dannon . | |
| 4,196,817 | 4/1980 | Moser | 215/1 A X |
| 4,420,097 | 12/1983 | Motsenbocker . | |
| 4,462,503 | 7/1984 | Di Raffaele et al. | 215/1 A X |
| 4,526,298 | 7/1984 | Boxer et al. . | |
| 4,544,087 | 10/1985 | Modig | 224/148 |

FOREIGN PATENT DOCUMENTS

| | | | |
|---|---|---|---|
| 508 | of 1869 | United Kingdom | 224/148 |
| 14646 | of 1885 | United Kingdom | 224/148 |

*Primary Examiner*—Linda J. Sholl
*Attorney, Agent, or Firm*—James C. Paschall

[57] ABSTRACT

This invention pertains to a container for liquid which has strap members capable of securing the container to a user's neck. A straw is inserted into the container for the removal of liquid. When not in use, the straw will be secured by a retaining member. Adhesive is placed along the back side of the container to be secured to the user's clothing so as to reduce movement of the container during activity such as running or bicycling.

17 Claims, 2 Drawing Sheets

FIG. 1
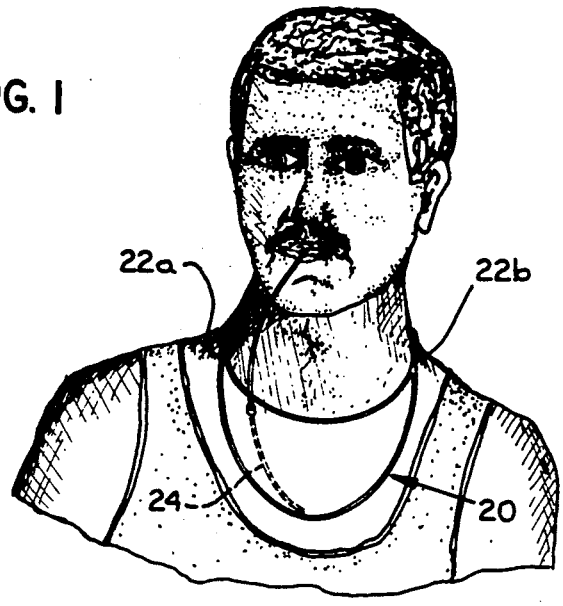
FIG. 3
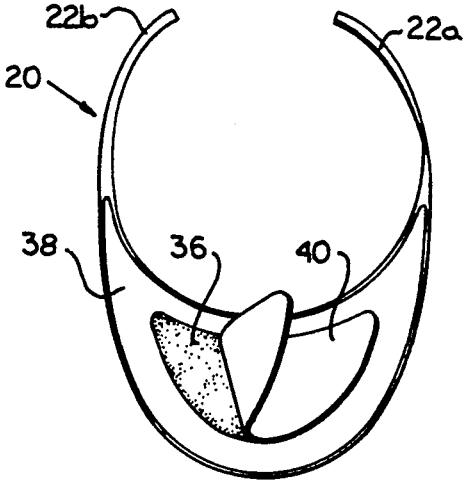
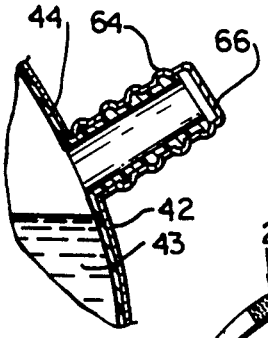
FIG. 13
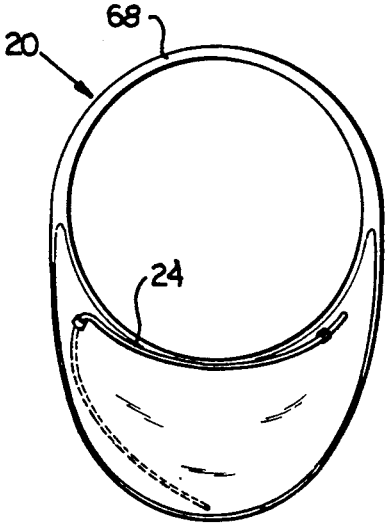
FIG. 14
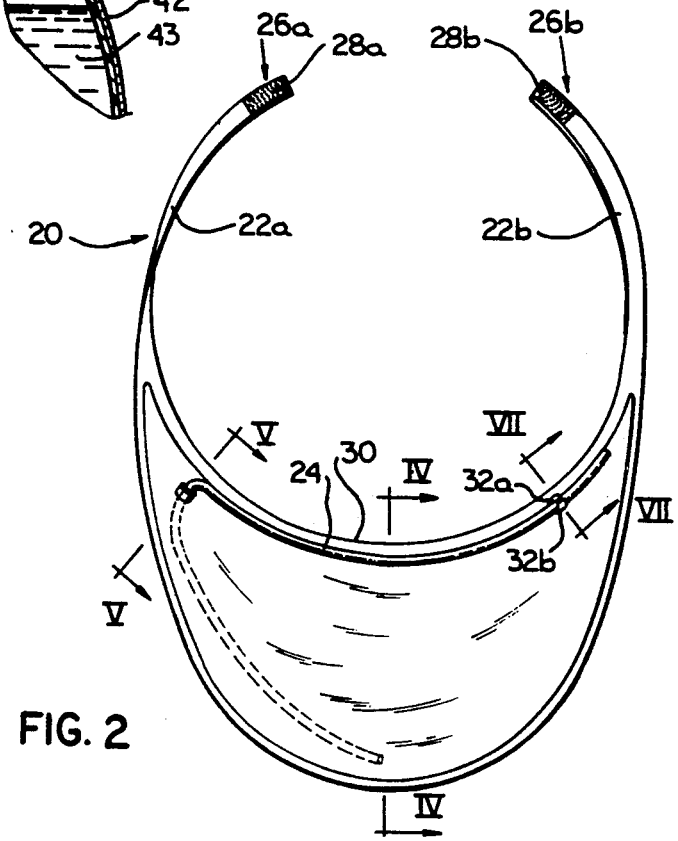
FIG. 2
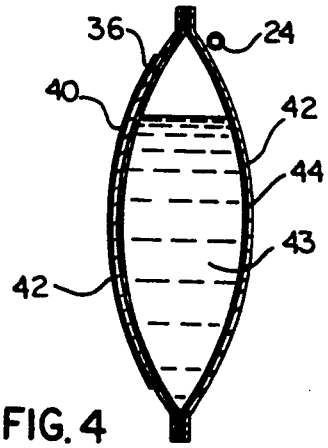
FIG. 4

JOGGERS AID

This is a continuation of co-pending application Ser. No. 927,159 filed on Nov. 5, 1986, entitled "JOGGERS' AID" now abandoned, which is a continuation of application Ser. No. 798,406, filed Nov. 15, 1985, entitled "JOGGERS' AID", now abandoned.

BACKGROUND OF THE INVENTION

This invention relates to a device which would provide a user with access to a fluid during strenuous activity such as bicycling or jogging while enabling his hands to be free.

One of the major problems with exercising is the inability to conveniently carry a supply of liquid to replenish the fluids which are excreted by the body during exercise. Under certain conditions, a person exercising may lose an excessive amount of fluids resulting in faintness, heat stroke, or on rare occasions, death. Because of the inconvenience of carrying a container of fluid in one's hand while exercising, people simply refrain from carrying containers with them while engaging in exercise.

Previous devices have consisted of apparatuses which fit either over a person's shoulders to be carried on the back, or around the waist. These devices are quite cumbersome and extremely impractical when used during exercise. The fluid is usually stored in a container located too far away from a user's mouth, requiring a great deal of suction to move the liquid to the user's mouth. Since the user is already expending considerable energy during exercise, such devices are considered hindrances rather than aids.

SUMMARY OF THE INVENTION

The present invention relates to a container for fluid which is capable of being secured around a user's neck so as to provide the user with a ready supply of easily accessible fluid during exercise. More specifically, the device comprises a generally U-shaped container having individual straps at each end of the container which are capable of being secured around the user's neck. The container will be relatively thin so as to be capable of holding a sufficient amount of liquid without causing discomfort to the user while exercising.

The container may either be rigid or flexible, while the interior of the container is preferably insulated so as to minimize the thermal exchange effects between the user's body and the container. The strap members may be secured to one another through a variety of means. One means would be projecting member extending from one strap and capable of being inserted into a corresponding aperture member on the opposite strap. An alternative means for securing the straps would be a series of projections extending from the ends of each strap which would be capable of being inserted into the spaces formed between projecting members in an interlocking fashion when the straps are pressed together.

Still a third means of securing the strap members together would be by placing adhesive material at the ends of each strap, such as VELCRO ®, which may be pressed together to form a secure means to hold a container. All three securing means identified above may be readily locked and unlocked by the user.

Adhesive is formed on the back side of the container which, when pressed against the clothing of the user, will reduce the movement of the container during exercise. The adhesive will be formed on the back side of the container and will be covered by a strip of contact paper which may be readily removed by the user prior to exercise.

A straw member will extend from the bottom center portion of the container up through the wall of the container to the user's mouth. When not in use, the user may fold the straw across the ridge of the container and secure it thereto with insertion of the straw between two inwardly-biased, upright projection members.

The straw member itself may have one or more accordion joint members in that portion of the straw extending from the container. The purpose of these accordion joints is to provide the user with flexibility during use at physical activity and to facilitate the folding of the straw when not in use into the slot formed by the extension members.

As an alternative embodiment, the container may have a hollow threaded extension portion formed on the wall of the container so as to provide communication with the interior of the container. A threaded cap member would be capable of being screwed onto the threaded extension member to form an air-tight, liquid-tight seal. When desired, the user would simply screw off the cap and insert a straw through the extension portion into the container to remove the liquid.

It is an objective of this invention to provide a user with a convenient means for storing and drinking liquid during physical activity.

BRIEF DESCRIPTION OF THE DRAWINGS

FIG. 1 is a perspective view of the container in use.

FIG. 2 is a front plan view of the container.

FIG. 3 is a rear plan view of the container.

FIG. 4 is a cross-sectional view of the container along lines IV—IV of FIG. 2.

FIG. 13 is an enlarged view of a threaded extension member formed on the container.

FIG. 14 is an alternate embodiment of the invention.

DESCRIPTION OF THE PREFERRED EMBODIMENT

Figure 9:
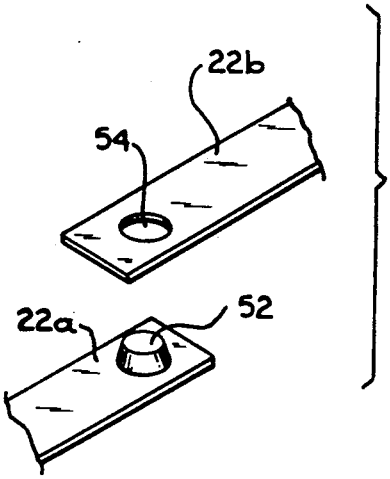
FIG. 9 is an enlarged view of the securing means for the strap members.

In the drawings, FIG. 1 illustrates a container 20 as it is intended to be used. The container 20, ordinarily made of plastic, such as polyethylene or polypropylene, is a generally arcuate or C-shaped configuration with a flared mid-portion and having a pair of strap members **22*a*, 22*b*, extending from the ends of said arcuate-shaped container 20 and secured to one another around a user's neck. A straw member 24 extends generally from the lowest mid-point of the container 20 through the wall of the container up to the user's mouth. Liquid may be extracted from the container by the user by sucking on the end of the straw 24**.

FIG. 2 is a more detailed perspective of the container 20. End portions 26*a*, 26*b* of strap members 22*a*, 22*b* have a self-adhesive substance 28*a*, 28*b* such as VELCRO® placed in such a manner so that when pressed together by the user, the end members 26*a*, 26*b* will adhere to one another with sufficient strength to support the container 20. The adhesive substance 28*a*, 28*b* will be of sufficient strength to support the container but will render the end members capable of being pulled apart without a great deal of effort by the user.

As shown in FIG. 2, the straw 24 is not being used. When not in use, it is intended that the straw member will lay along the upper ridge 30 of the container 20 and will be secured thereto by insertion between a pair of inwardly-biased projection members, 32*a*, 32*b*. The straw 24 may be inserted and removed from the projection members 32*a*, 32*b* repeatedly without detrimental effect to the integrity of the straw 24. The projection members 32*a*, 32*b* are formed generally along the upper ridge 30 of the container 20.

In order to prevent excessive movement of the container 20 during exercise, FIG. 3 shows a second adhesive substance 36 placed on a back side 38 of the container 20. This second adhesive 36 may also be VELCRO®. Prior to use, the second adhesive substance 36 is covered by a strip of tear-away contact paper 40. As shown in FIG. 3, when required for use, the user will tear of the paper 40 and press the second adhesive substance against his or her clothing. In this manner, the container 20 will be secured primarily by strap members 22*a*, 22*b*, and secondarily, by the second adhesive substance 36 pressing against the user's clothing. The primary purpose of this second adhesive substance 20 is to prevent excessive movement of the container 20 during exercise.

As shown in FIG. 4, insulating material 42 such as aluminm may be placed around center portion 43 of container 20 for the purpose of maintaining the liquid contained therein at a specified temperature, and to minimize any thermal exchange which might occur between the liquid contained in the container 20 and the user's body. Additionally, the interior walls of the container may be lined with insulation material to reduce thermal exchange between the user's body and the container. As an alternative insulation, a hollow space can be formed between the outer wall of the container 20 and the center portion 43.

Figure 5:
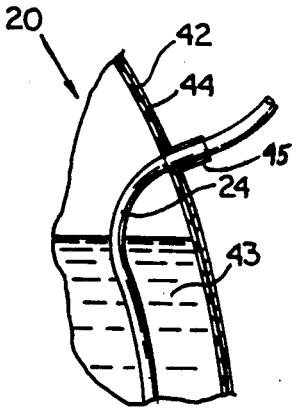
FIG. 5 is a cross-sectional view of the container along lines V—V of FIG. 2.
Figure 6:
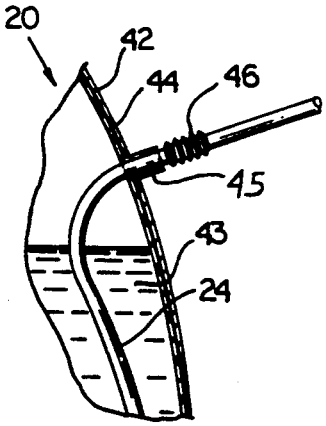
FIG. 6 is an enlarged sectional view of an alternative embodiment of the straw member of the container shown in FIG. 5.

FIG. 5 shows the straw 24 extending through a front wall 44 of the container 20. FIG. 6 shows an accordion joint member 46 is formed on straw member 44 to provide the user with maximum flexibility in maneuvering the straw to his/her mouth during physical activity. Additionally, the accordion joint member 46 provides a degree of safety to the user in that it would diminish serious injury during a fall while the user is drinking.

Figure 7:
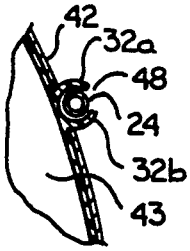
FIG. 7 is a cross-sectional view of the container along lines VII—VII of FIG. 2.

In FIG. 7, the straw 24 is inserted between the two inwardly-biased projection members 32*a*, 32*b*. In this illustration, the projection members 32*a*, 32*b* are generally C-shaped. The straw 24 may be lifted out of a slot 48 formed between the projection members 32*a*, 32*b* repeatedly without any detrimental effect to the integrity of the straw 24. The inward bias of the projection members 32*a*, 32*b* will be sufficient merely to secure the straw without causing any damage to the straw 24 by repeated removal and replacement. It is contemplated that the projection members 32*a*, 32*b* will be formed directly on the front wall 44 of the container 20 in a one-piece construction.

Figure 8:
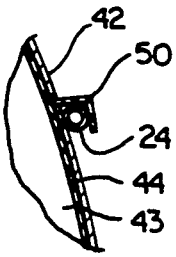
FIG. 8 is an alternative embodiment of the securing means shown in FIG. 7.

An alternative embodiment to the projection members 32*a*, 32*b* is shown in FIG. 8. A generally L-shaped member 50 is formed on the front wall 44 in a one-piece construction. The straw 24 may be inserted and secured between one side of the L-shaped member 50 and the front wall 44. As in the previous embodiment shown in FIG. 7, it is contemplated that the L-shaped member 50 will be sufficiently inwardly-biased to secure straw 24 while permitting easy removal and insertion without damage to the straw.

Figure 10:
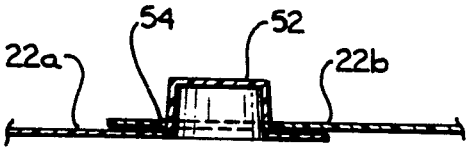
FIG. 10 is a side view of the securing means shown in FIG. 9.

FIGS. 9 and 10 show one means to secure the strap members together so as to support the container in use. An upwardly-directed projection member 52 is formed on strap 22*a* while a corresponding aperture is formed on strap 22*b*. When use is desired, the user will insert a projection member 52 into the aperture 54 so as to secure straps 22*a* and 22*b* together, enabling the container 20 to be supported around the user's neck. When the user wishes to remove the container from around his/her neck, the user will merely push the projection member 52 through the aperture 54, disconnecting the strap members 22*a* and 22*b*.

Figure 11:
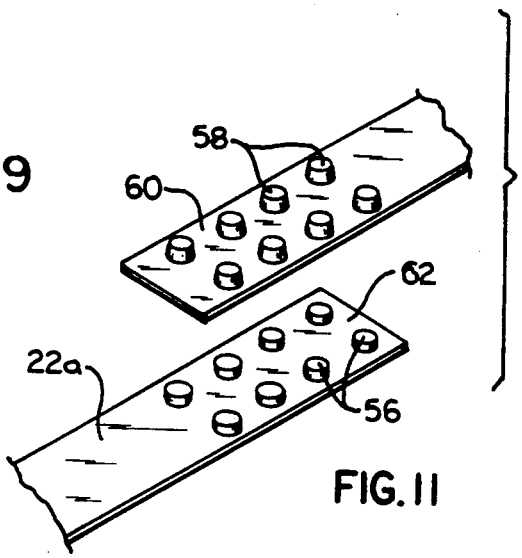
FIG. 11 is an alternative securing means for the strap members.
Figure 12:
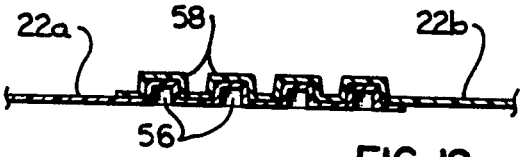
FIG. 12 is a side view of the alternate securing means shown in FIG. 11.

An alternative means to secure the strap members is illustrated in FIGS. 11 and 12. FIG. 11 shows a series of closely spaced, upwardly-directed projection members 56 formed on strap 22*a* and corresponding number of closely spaced, downwardly-directed projection members 58 on strap 22*b*. When the user desires to secure the straps together, he/she will compress the straps 22*a* and 22*b* together so that the series of upwardly-directed, spaced projection members will be inserted into spaces 60 formed by the series of downwardly-directed, spaced projection members strap 22*b*. Correspondingly, the series of downwardly-directed, spaced projection members 58 will be inserted into spaces 62 formed by the upwardly-directed, spaced projection members 56. In this manner, a grid will be formed capable of securing the container to the user's neck. When use is no longer required, the user will merely lift strap 22*b* from strap 22*a* and the connection will be broken.

One alternative to the present invention is shown in FIG. 13. A threaded extension member 64 is formed on the upper ridge 30 of the container 20. A threaded cap 66 is formed such that it may be screwed onto the threaded extension member 64 so as to form an air-tight, liquid-tight seal. When use is desired, the cap 66 may be unscrewed and the straw 24 may be inserted through the extension member 24 into the container 20.

FIG. 14 represents a second alternative embodiment to the present invention in which the container is secured around the user's neck by means of a ring 68 formed from the same material as the container 20. That is, container 20 and ring 68 are a one-piece device. The container is simply slipped over the user's head and may be removed in the same fashion.

Variations and modifications of the present invention may be made and remain within the spirit of applicant's invention as defined herein.

I claim:

1. A container for holding liquid around a user's neck comprising:

means defining an integral, hollow, generally flat, substantially symmetrical arcuate-shaped container having a pair of front and rear walls which are substantially symmetrical to one another on either side of an imaginary plane extending through the center line of said front and rear walls, said front and rear walls joined peripherally at the edges, with said rear wall generally contoured in a substantially flat shape for disposition adjacent the user's front;

aperture means formed on an upper arcuate-shaped portion and intermediate the end portions of said arcuate-shaped container for delivering liquid through the intermediately disposed aperture means upwardly during use into the user's mouth;

strap means extending from the end portions of said container and continuously supporting said container around the user's neck during use in non-constricting disposition and disposing said rear wall of said arcuate-shaped container adjacent the user's front to position said aperture means in upwardly directed disposition for delivering liquid upwardly therefrom during use; and a straw member extending upwardly from said container so as to enable the user to remove the liquid contents therefrom by means of suction, whereby the user is able to suction liquid upwardly from the container while engaging in physical exercise.

2. The container according to claim 1 in which said arcuate-shaped hollow container has a flared mid-portion so that the entire containermay be filled with liquid.

3. The container according to claim 1 in which said strap members are secured to one another by means of a vertical projection member extending from one strap member and capable of being inserted into a corresponding aperture formed on the second strap.

4. The container according to claim 1 in which said strap members are secured to one another by means of a series of spaced projections formed in each strap member and capable of being pushed together in such a manner that the projections of one strap may be inserted into the spaces formed between the projection members of the other strap.

5. the container according to claim 1 in which said straw member has one or more elbows formed on that portion of said straw member extending above said container so as to enable said straw to be folded.

6. The container according to claim 1 in which a bracket member is formed on said container so as to receive the straw and hold it in a folded position until required for use.

7. A container for holding liquid around a user's neck comprising:

means defining an integral, hollow, generally flat, substantially symmetrical arcuate-shaped container having a pair of front and rear walls which are substantially symmetrical to one another on either side of an imaginary plane extending through the center line of said front and rear walls, said front and rear walls joined peripherally at the edges, with said rear wall generally contoured in a substantially flat shape for disposition adjacent the user's front;

a pair of strap members extending from said container which are capable of being secured to one another so as to support said container around the user's neck when filled with liquid;

an adhesive material disposed on the rear wall disposed adjacent the user's chest; and a straw member extending upwardly from said container so as to enable the user to remove the liquid contents therein by means of suction.

8. The container according to claim 1 in which the walls of said hollow container are insulated with insulation material to reduce thermal exchange between the user's body and the container.

9. The container according to claim 1 in which a hollow space is formed between the exterior wall of said container and the hollow center portion of the container.

10. A container for holding liquid around a user's neck comprising:

means defining an integral, hollow, generally flat, substantially symmetrical arcuate-shaped container having a pair of front and rear walls which are substantially symmetrical to one another on either side of an imaginary plane extending through the center line of said front and rear walls, said front and rear walls joined peripherally at the edges, with said rear wall generally contoured in a substantially flat shape for disposition adjacent the user's front;

a hollow threaded extension member formed on an upper arcuate-shaped portion substantially intermediate the end portions of said arcuate-shaped container so as to provide means for delivering liquid in a generally upward direction to user's mouth;

a strap extending from said container which is capable of continuously supporting the container when filled with liquid around the user's neck during exercise; and a straw extending upwardly from said container through said extension member, whereby the user may continuously suction liquid upwardly from the container while engaging in physical exercise.

11. The container according to claim 10 in which an air-tight, liquid-tight seal may be formed over said threaded extension member by means of a threaded cap.

12. A container for holding liquid around a user's neck comprising:

a one-piece hollow, substantially symmetrical, thin generally arcuate-shaped container having a pair of substantially symmetrical front and rear walls which are substantially symmetrical to one another on either side of an imaginary plane extending through the center line of said front and rear walls, said front and rear walls joined along their periphery, with said rear wall generally contoured in a substantially flat shape for disposition against the user's front;

an aperture formed on an upper arcuate portion substantially intermediate the end portions of said arcuate-shaped container for delivering liquid to the user;

an integral ring member formed on said container which is capable of being placed over a user's head and providing continuous support for the container during use; and a straw member extending upwardly from said container so as to enable the user to remove the liquid contents therein by means of suction, whereby the user may remove and consume liquid from said container continuously while engaging in physical exercise.

13. A container for holding liquid around a user's neck comprising:

means defining an integral, hollow, thin, flat, substantially symmetrical, generally arcuate-shaped container having a pair of front and rear walls which are substantially symmetrical to one another on either side of an imaginary plane extending through the center line of said front and rear walls, with said rear wall generally contoured in a substantially flat shape for disposition against the user's chest;

aperture means formed on the upper arcuate portion between the end portions of said arcuate-shaped container for delivering liquid upwardly to the user; and strap means extending from said container to continuously support the container when filled with liquid around the user's neck during exercise, so that the user may remove liquid from the container without interruption.

14. The container according to claim 13 having means for holding down the container against the user's body.

15. The container according to claim 14 wherein said means for holding down the container comprises means for securing said container to the torso of the user.

16. The container according to claim 14 wherein means for securing said container to said user's body is attached to the exterior of the rear wall of said container.

17. A container for holding liquid comprising:

means defining an integral, hollow, thin, flat, substantially symmetrical, generally arcuate-shaped container having a pair of front and rear walls which are substantially symmetrical to one another on either side of an imaginary plane extending through the center line of said front and rear walls, with said rear wall generally contoured in a substantially flat shape for disposition against the user's chest; and aperture means formed on the upper arcuate portion between the end portions of said arcuate-shaped container for delivering liquid upwardly to the user.

* * * * *